US005884916A

United States Patent [19]

Yiu

[11] Patent Number: 5,884,916

[45] Date of Patent: Mar. 23, 1999

[54] DARTBOARD HAVING A PROTECTIVE TARGET

[76] Inventor: Chih-Hao Yiu, 6F-2, No. 160, 1 Section, Chungkang Road, Taichung, Taiwan

[21] Appl. No.: 885,506

[22] Filed: Jun. 30, 1997

[51] Int. Cl.[6] ..... F41J 3/00

[52] U.S. Cl. ..... 273/403; 273/408

[58] Field of Search ..... 273/403, 404, 273/408

[56] References Cited

U.S. PATENT DOCUMENTS 5,188,372 2/1993 Tadej ..... 273/408

*Primary Examiner*—William H. Grieb

*Attorney, Agent, or Firm*—Charles E. Baxley, Esq.

[57] ABSTRACT

A dartboard includes a circular spider disposed on the front portion having series of circunferentially and radially extending ribs for forming a number of dart areas and for slidably receiving a number of dart segments. A further spider of metal material is secured on the upper portion of the ribs of the spider for protecting the ribs and for preventing the ribs from being damaged by darts. The upper portions of the ribs each includes a frustum shape having two tapered side surfaces and having a flat upper surface. A protective outer film is applied onto the upper surface of the further spider and for protecting the ribs.

3 Claims, 3 Drawing Sheets

DARTBOARD HAVING A PROTECTIVE TARGET

BACKGROUND OF THE INVENTION

1. Field of the Invention

The present invention relates to a dartboard, and more particularly to a dartboard having a target frame that has a protective device for protecting the target frame from being damaged.

2. Description of the Prior Art

Typical dartboards comprise a dartboard body having a spider provided in the front portion. The spider is generally circular in shape including a series of circumferentially and radially extending ribs for defining a number of dart areas and for slidably receiving a number of dart segments which are slidably engaged in the dart areas. The spider is normally made by plastic material and includes a number of cusps formed on the top of the series of circumferentially and radially extending ribs. However, the spider including the cusps is made of plastic material and will be easily damaged by the darts. The whole dartboard may be required to be discarded once the cusps are damaged by the darts.

The present invention has arisen to mitigate and/or obviate the afore-described disadvantages of the conventional dartboards.

SUMMARY OF THE INVENTION

The primary objective of the present invention is to provide a dartboard including a spider having a protective device secured on top for protecting the spider and for preventing the spider from being easily damaged.

In accordance with one aspect of the invention, there is provided a dartboard comprising a dartboard body including a front portion, a first spider provided on the front portion of the dartboard body, the first spider being circular in shape including a series of circumferentially and radially extending ribs for deining a plurality of dart areas and for slidably receiving a plurality of dart segments, the ribs of the first spider including an upper portion, and a second spider secured on the upper portion of the ribs of the first spider for protecting the first spider and for preventing the first spider from being damaged by darts.

The upper portions of the ribs each includes a frustum shape having two tapered side surfaces for defining two side shoulders and for engaging with the dart segments, the upper portions of the ribs each includes a flat upper surface, the second spider includes a flat bottom surface for engaging with the flat upper surfaces of the ribs.

The second spider includes an upper surface and includes a protective outer film applied onto the upper surface for protecting the second spider.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
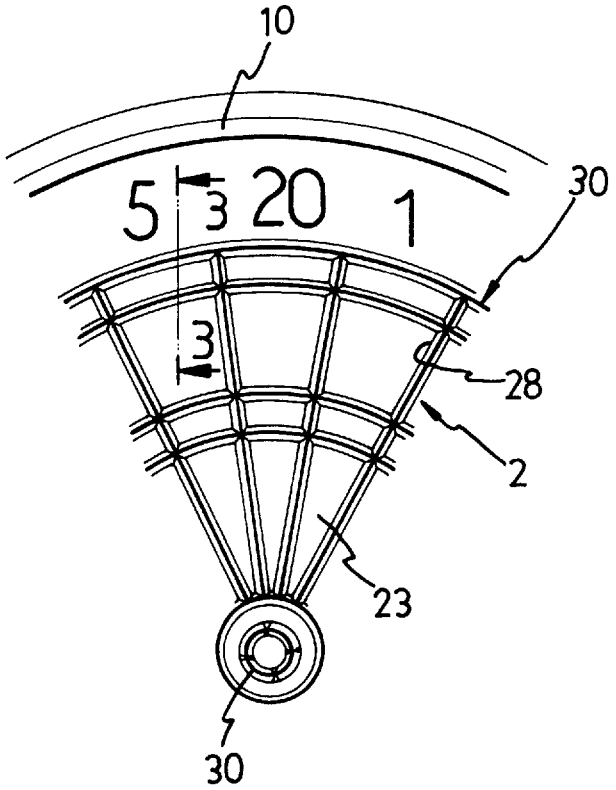
FIG. 1 is a partial plane view of a dartboard.
Figure 3:
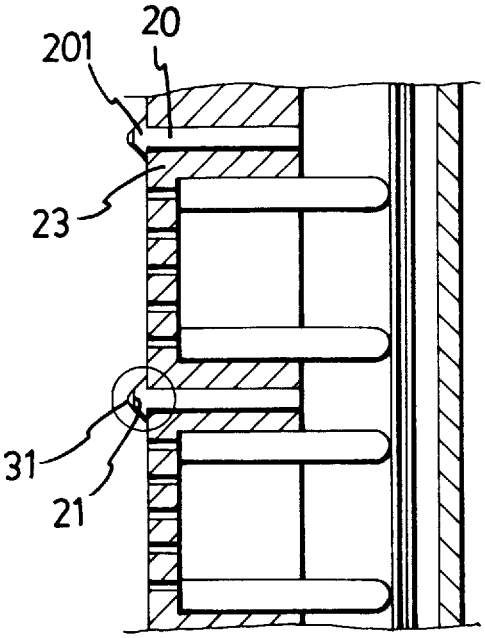
FIG. 3 is a cross sectional view taken along lines 3—3 of FIG. 1.
Figure 4:
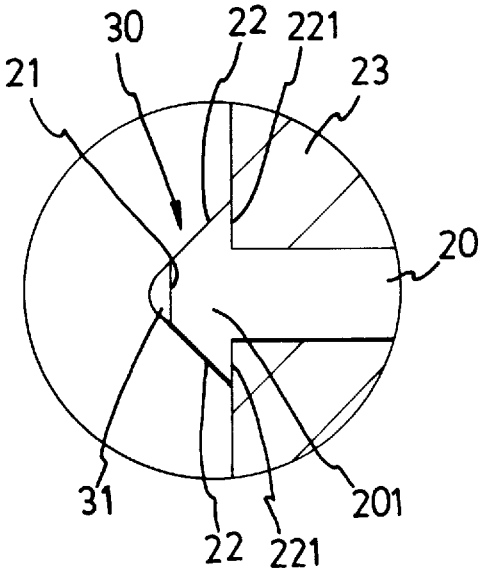
FIG. 4 is an enlarged partial cross sectional view of the dartboard.

Referring to FIGS. 1, 3 and 4, a dartboard in accordance with the present invention comprises a dartboard body 10 having a spider 2 provided in the front portion. The spider 2 is generally circular in shape including a series of circumferentially and radially extending ribs 20 for deining a number of dart areas 28 and for slidably receiving a number of dart segments 23 which are slidably engaged in the dart areas 28. The circumferentially and radially extending ribs 20 of the spider 2 each includes a frustum shaped upper portion 201 having two tapered side surfaces 22 for defining two side shoulders 221 which are provided for engaging with the dart segments 23 and for preventing the dart segments 23 from being disengaged from the spider 2. The frustum shaped upper portions 201 of the circumferentially and radially extending ribs 20 each includes a flat upper surface 21.

Figure 2:
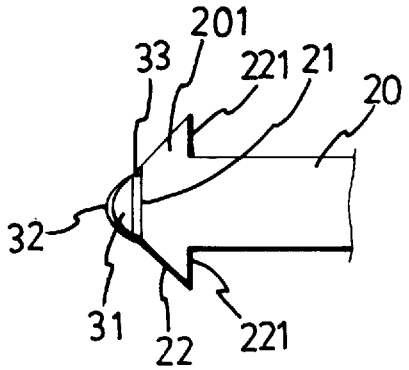
FIG. 2 is a partial plane view of a protective device for disposing on top of the spider.

A further spider 30 is made of metal material and includes a flat bottom surface for securing to the flat upper surface 21 of the ribs 20 of the spider 2 by adhesive material 33 (FIG. 2). The adhesive material 33 is preferably the hot melting glue that may be melted under heat. In addition, the spider 30 preferably includes a protective film 32 applied onto the outer surface for protecting the spider 30. The protective film 32 may be removed according to the user's desire. The spider 30 may include or may be applied with a color different from that of the spider 2 such that the user may clearly see the dart areas 28. Furthermore, the spider 30 which is made of metal includes a greater strength for protecting the spider 2 and for preventing the spider 2 from being damaged by the darts. The provision of the spider 30 prevents the whole ribs 2 from being made by metal material such that the manufacturing cost may be decreased and such that the ribs 2 may be suitably protected.

Accordingly, the dartboard includes a spider secured on top of ribs for protecting the ribs and for preventing the ribs from being damaged by darts.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dartboard comprising:

a dartboard body including a front portion, a first spider provided on said front portion of said dartboard body, said first spider being circular in shape including a series of circumferentially and radially extending ribs for defining a plurality of dart areas and for slidably receiving a plurality of dart segments, said ribs of said first spider including an upper portion, and a second spider secured on said upper portion of said ribs of said first spider for protecting said first spider and for preventing said first spider from being damaged by darts.

2. A dartboard according to claim 1, wherein said upper portions of said ribs each includes a frustum shape having two tapered side surfaces for defining two side shoulders and for engaging with said dart segments, said upper portions of said ribs each includes a flat upper surface, said second spider includes a flat bottom surface for engaging with said flat upper surfaces of said ribs.

3. A dartboard according to claim 1, wherein said second spider includes an upper surface and includes a protective outer film applied onto said upper surface for protecting said second spider.

* * * * *